United States Patent [19]

Falk

[11] Patent Number: 4,939,682

[45] Date of Patent: Jul. 3, 1990

[54] INTEGRATED ELECTRO-OPTIC ARITHMETIC/LOGIC UNIT AND METHOD FOR MAKING THE SAME

[75] Inventor: R. Aaron Falk, Renton, Wash.

[73] Assignee: The Boeing Company, Seattle, Wash.

[21] Appl. No.: 219,276

[22] Filed: Jul. 15, 1988

[51] Int. Cl.[5] ..... G06E 1/06

[52] U.S. Cl. ..... 364/713; 350/96.14

[58] Field of Search ..... 350/96.14; 364/713, 364/746

[56] References Cited

U.S. PATENT DOCUMENTS

| | | | |
|---|---|---|---|
| 4,064,400 | 12/1977 | Akushsky et al. | 364/746 |
| 4,121,298 | 10/1978 | Akushsky et al. | 364/746 |
| 4,363,106 | 12/1982 | Tai | 364/713 |
| 4,403,833 | 9/1983 | Kenan et al. | 350/96.14 |
| 4,418,394 | 11/1983 | Tai | 364/746 |
| 4,567,355 | 1/1986 | Schuoecker et al. | 364/746 |
| 4,797,843 | 1/1987 | Falk et al. | 364/713 |

OTHER PUBLICATIONS

Beaudet et al., "Residue arithmetic techniques for optical processing of adaptive phased array radars", *Applied Optics*, vol. 25, #18, pp. 3097–3112, Sep. 15, 1986.

Tai et al., "Optical residue arithmetic computer with programmable computation modules", *Applied Optics* vol. 18, #16, pp. 2812–2823, Aug. 15, 1979.

"Residue Arithmetic Circuit Design Based on Integrated Optics", by Huang et al., SPIE vol. 321, Integrated Optics II, 1982.

MacDonald et al, "Hybrid Optoelectronic Integrated Circuit," Applied Optics, vol. 26, No. 5, Mar. 1, 1987, pp. 842–844.

Horrigan and Stoner, "Residue-based Optical Processor," SPIE, vol. 185, Optical Processing Systems (1979), pp. 19–27.

Leonberger, "Applications of InP Photoconductive Switches," SPIE, Vo. 272 High Speed Photodedectors (1981), pp. 58–63.

*Primary Examiner*—Dale M. Shaw

*Attorney, Agent, or Firm*—Foley & Lardner, Schwartz, Jeffery, Schwaab, Mack, Blumenthal & Evans

[57] ABSTRACT

An integrated electro-optic arithmetic/logic apparatus has an optical substrate and an electrically active substrate. Optical waveguides are provided on the surface of the optical; substrate, while active devices such as detectors, threshold circuits and sources are formed in the electrically active substrate. The two substrates are integrated to form a single chip device. Intersecting regions of the optical waveguides are monitored by the detectors and threshold circuits to provide output signals corresponding to a desired arithmetic/logic operation.

18 Claims, 4 Drawing Sheets

| $x_2$ \ $x_1$ | 0 | 1 |
|---|---|---|
| 0 | 0 | 0 |
| 1 | 0 | 1 |

| $x_2$ \ $x_1$ | 0 | 1 |
|---|---|---|
| 0 | 0 | 1 |
| 1 | 1 | 0 |

| $x_2$ \ $x_1$ | 0 | 1 | 2 |
|---|---|---|---|
| 0 | 0 | 1 | 2 |
| 1 | 1 | 2 | 0 |
| 2 | 2 | 0 | 1 |

| $x_2$ \ $x_1$ | 0 | 1 | 2 | 3 | 4 |
|---|---|---|---|---|---|
| 0 | 0 | 0 | 0 | 0 | 0 |
| 1 | 0 | 1 | 2 | 3 | 4 |
| 2 | 0 | 2 | 4 | 1 | 3 |
| 3 | 0 | 3 | 1 | 4 | 2 |
| 4 | 0 | 4 | 3 | 2 | 1 |

| $x_2$ \ $x_1$ | 0 | 1 | 2 | 4 | 3 |
|---|---|---|---|---|---|
| 0 | 0 | 0 | 0 | 0 | 0 |
| 1 | 0 | 1 | 2 | 4 | 3 |
| 2 | 0 | 2 | 4 | 3 | 1 |
| 4 | 0 | 4 | 3 | 1 | 2 |
| 3 | 0 | 3 | 1 | 2 | 4 |

INTEGRATED ELECTRO-OPTIC ARITHMETIC/LOGIC UNIT AND METHOD FOR MAKING THE SAME

BACKGROUND OF THE INVENTION

The invention relates generally to optical information processing and, in particular, to an integrated electro-optical cross-bar apparatus for performing parallel optical logic and arithmetic operations.

There is a fundamental difference between optical circuits, in which the information carriers are photons, and electronic circuits, where the carriers are electrons. In the former case the carriers do not interact with each other, while in the latter they do. This means that in optical devices there exist interconnect possibilities that do not exist with electronic hardware, in particular, interconnected parallel architectures which permit digital arithmetic and logic operations to be performed in a completely parallel, single step process. After the inputs are switched on, the output appears in the time it takes a photon to transit the device. No faster computation time is possible.

Copending application Serial Number 019,761, filed Feb. 27, 1987 of Falk et al describes an optical cross-bar arithmetic/logic unit that performs the abovementioned single step process by employing residue arithmetic. Residue arithmetic does not have a "carry" operation; that is, each "bit" in the representation is independent of the other. In residue arithmetic, each "bit" in a representation of a number is the decimal value of the number modulo the prime number corresponding to that position, called the modulus.

The optical cross-bar arithmetic/logic unit disclosed in the abovementioned copending application utilizes crossed optical paths of light configured to define intersecting regions with each other corresponding to truth table or logic table inputs. The intensity of light at each intersecting region is detected to determine if two units of light intensity are present at each intersection, thereby indicating a particular logic state.

In order to maximize performance and reduce the size of the optical cross-bar arithmetic/logic unit, it is desirable that the waveguides and electronic detectors of an optical cross-bar arithmetic/logic unit be formed together in a single integrated electro-optic chip. Difficulties arise in the fabrication of an electro-optic chip, however, as the desirable material properties for fabricating electronic sources, detectors and transistors are directly opposite to the properties needed for quality waveguides.

SUMMARY OF THE INVENTION

Accordingly, it is an object of the present invention to provide an integrated electro-optic apparatus and method for making the same.

It is a further object of the present invention to provide an integrated electro-optic apparatus for performing parallel optical logic and arithmetic operations.

It is a still further object of the present invention to provide an integrated electro-optic apparatus in which through-put delays are equalized.

These and other objects are achieved by the instant invention which provides an integrated electro-optic apparatus having an optical substrate and an electrically active substrate. Optical waveguides are provided on the surface of the optical substrate, while active devices such as detectors and sources are formed in the electrically active substrate. The two substrates are integrated to form a single chip device.

More specifically the instant invention provides an integrated electo-optic arithmetic/logic device including: an optical substrate having a plurality of optical waveguides formed in a desired pattern thereon, the optical waveguides intersecting one another to form a plurality of intersection regions, a plurality of separately energizable light sources corresponding in number to the number of waveguides, wherein energized light sources correspond to inputs of a desired arithmetic or logic operation to be performed; and an electrically active substrate having a plurality of electro-optic detectors corresponding to the plurality of intersecting regions, and a plurality of output terminals, wherein each detector is positioned proximate an intersecting region for receiving light therefrom and the detectors are connected to the output terminals of the electrically active substrate to provide an arithmetic or logical output of the desired arithmetic or logic operation respectively.

Other objects and advantages of the invention will become apparent with reference to the specification and drawings contained herein.

Figures 1, 2A, 2B, 2C, 3A, 3B:
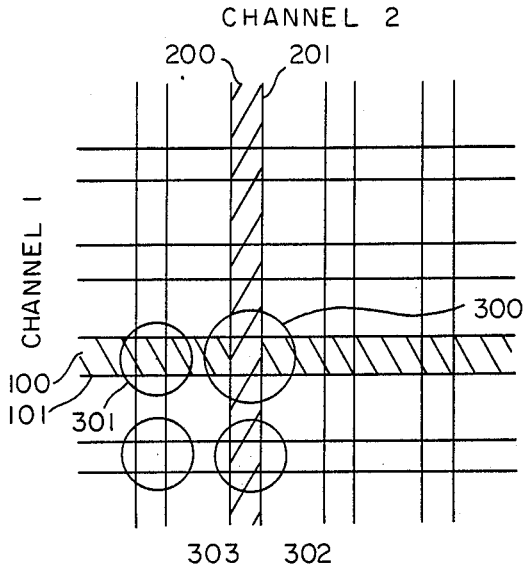
FIG. 1 is a schematic drawing showing the basic concept of an optical cross-bar arithmetic/logic unit.
Figure 6:
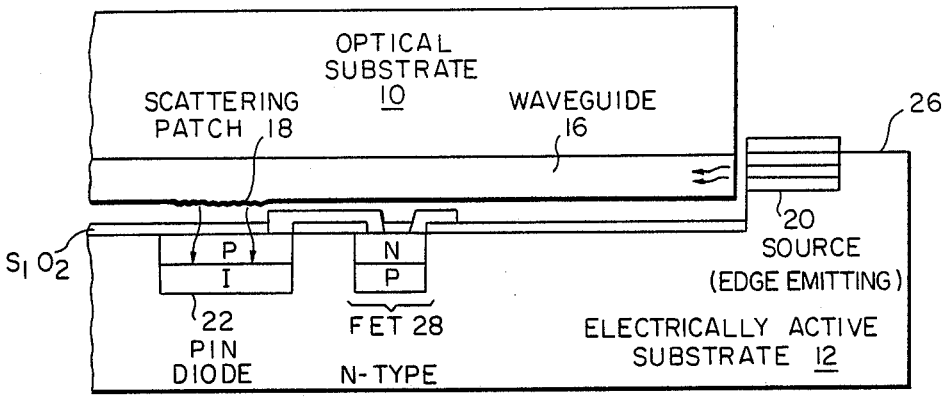

FIGS. *2a–2c* illustrate examples of possible truth tables that can be achieved by the optical cross-bar arithmetic/logic unit illustrated in FIG. 1;

FIGS. *3a* and *3b* illustrate a radix 5 residue multiplication table and its permuted table, respectively;

FIGS. *4a–4c* illustrate various techniques for providing optical coupling between a waveguide intersecting region and a detector;

FIG. *5a–5c* illustrate a first embodiment of an integrated electro-optic apparatus in accordance with the present invention, more specifically, FIG. *5a* illustrates a plan view of an optical substrate having waveguides formed thereon, FIG. *5b* schematically illustrates a top view of an electrically active substrate having a plurality of sources and detectors formed therein, and FIG. *5c* illustrates a cross-sectional view taken along the line *a—a* of FIGS. *5a* and *5b* of the optical substrate bonded to the electrically active substrate;

FIG. 6 illustrates optical coupling between the sources, waveguides and detectors of the device illustrated in FIG. *5c;*

Figure 7:
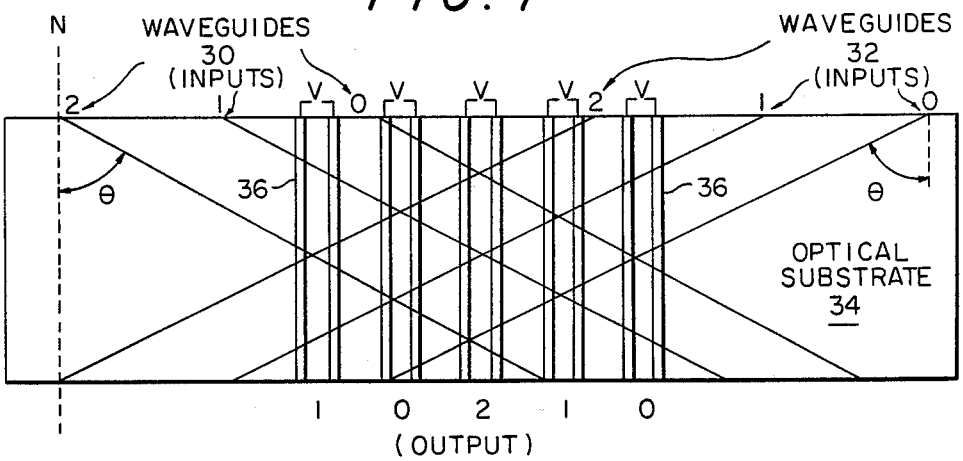
Figure 8:
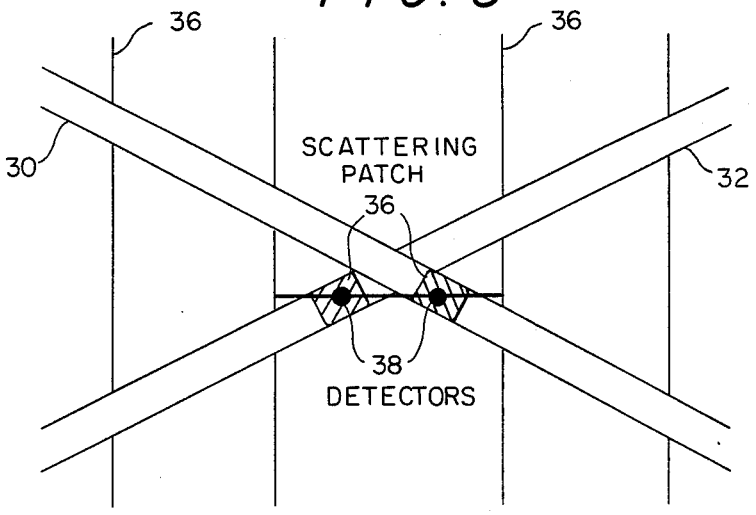

FIG. 7 illustrates a second embodiment of an integrated electro-optic apparatus in accordance with the present invention; and FIG. 8 illustrates in detail an intersection region of the integrated electro-optic apparatus shown in FIG. 7.

DETAILED DESCRIPTION OF THE PREFERRED EMBODIMENTS

Referring now to FIG. 1, the basic concept of the optical cross-bar arithmetic/logic unit (ALU) as described in copending application Serial No. 019,761 is shown using a 4×4 ALU. Input 100 from Channel 1 and input 200 from Channel 2 transmit light in optical paths 101 and 201 respectively to intersect at a region designated by reference number 300. Inputs 100 and 200 may comprise light sources coupled directly or indirectly to the optical paths 101 and 201 respectively. Thus, the level of light intensity at intersection region 300 is equivalent to two units of light. In comparison, the level of light intensity detected at intersecting regions 301 and 302 is only one unit of light, and the level of light intensity detected at intersecting region 303 is zero.

Some examples of possible truth tables that can be realized are shown in FIGS. 2 and 3. FIGS. 2*a* and 2*b* show examples of the kinds of two level logic tables associated with standard Boolean algebra, the AND and EXCLUSIVE-OR tables respectively. FIG. 2*c* shows an example of a multi-value logic table, specifically showing a table for radix 3 residue addition. The lack of carry operations is apparent, thus making parallel processing of residue addition possible. FIG. 3*a* shows a radix 5 residue multiplication table and FIG. 3*b* indicates how the reduced table (with zeros removed) can be made antidiagonal via permutation, as discussed by Szabo and Tanaka in *Residue Arithmetic and its Applications to Computer Technology,* McGraw-Hill, New York, 1977 and incorporated herein by reference. These tables are representative examples only as it is apparent that all possible multi-level logic tables can be constructed in a similar fashion.

Devices to evaluate all of these tables using the optical cross-bar technique can be constructed in accordance with the present invention in the form of an integrated electro-optic chip. As previously mentioned, an electro-optic chip according to the present invention contains at least two separate substrates, one for optical waveguides and one for active devices. The optical waveguides route optical signals to desired intersecting regions at which light is coupled out of the waveguides and provided to an active detection device in the electronic substrate.

Figure 4A:
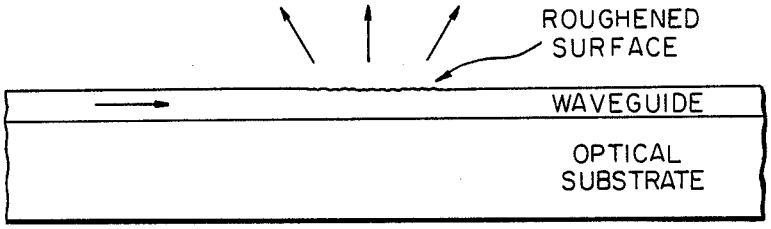
Figure 4B:
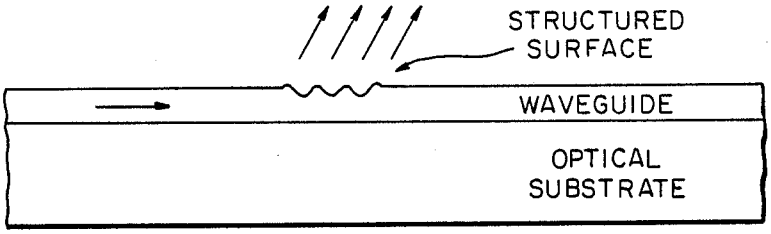

A variety of methods may be employed to accomplish the optical coupling at the intersecting regions. For example scattering patches can be used at the intersecting regions to scatter light from the waveguide to the detector as shown in FIGS. 4*a* and 4*b*. A first type of scattering patch shown in FIG. 4*a* is created by roughening the surface of an optical waveguide by chemical etching. The rough surface will scatter light more or less isotropically and a detector placed over the scattering patch will collect about half of the scattered light. Further details of the chemical etching process may be found in R. I. MacDonald et al *Hybrid Optoelectronic Integrated Circuit,* Applied Optics, Vol. 26, No. 5, pp. 842–844 (1987).

Figure 4C:
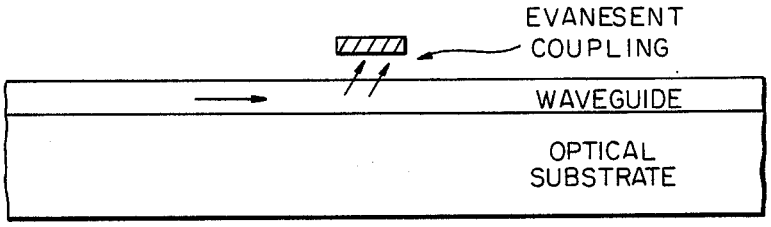

As shown in FIG. 4*b*, a structured surface such as an index grating may also be used as a scattering patch to couple light out of the waveguide. The light escapes the waveguide in a preferential direction providing a greater degree of collection efficiency, although the index grating is somewhat harder to manufacture than using the chemical etch technique. Another coupling technique is shown in FIG. 4*c* in which the detector is placed in close proximity to the waveguide. Evanescent coupling will then allow some of the light to leak into the detector where it will be absorbed. The evanescent coupling technique requires close tolerances for the coupling to occur (less than one micron) and therefore is also more difficult to manufacture than the chemical etch technique. Other possible techniques for performing optical coupling will be readily apparent to one of ordinary skill in the art. Further details of coupling light into and out of an optical substrate may be found in T. Tamir, *Topics in Applied Physics, Integrated Optics,* Vol. 7, Springer-Verlag, N.Y. (1975).

Figure 5A:
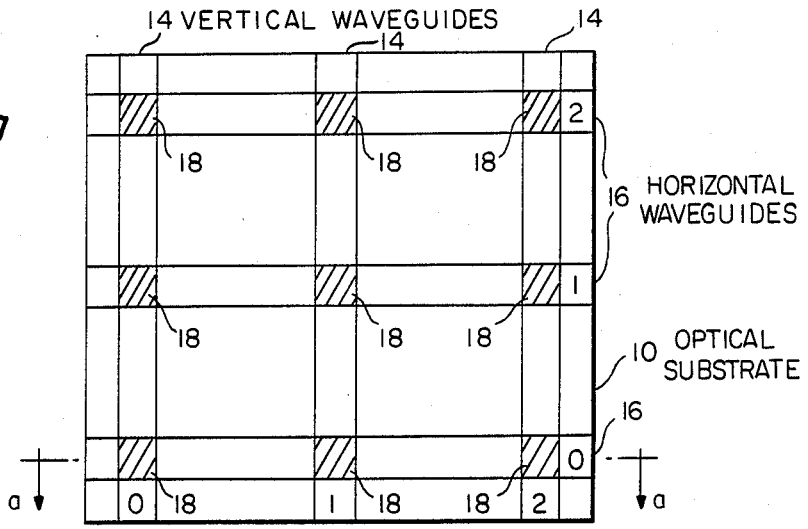
Figure 5B:
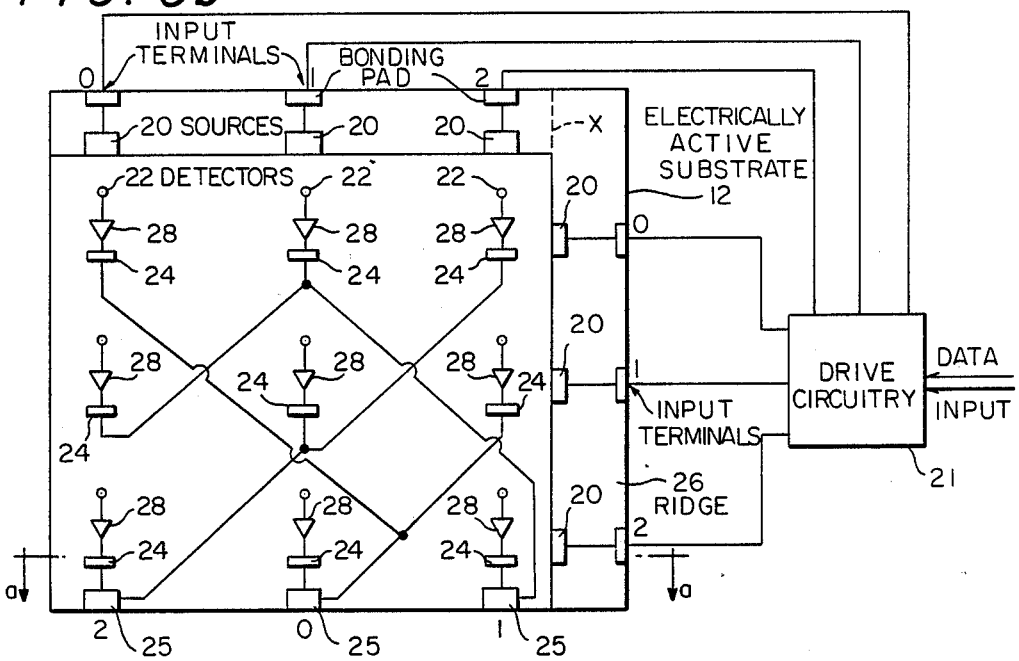
Figure 5C:
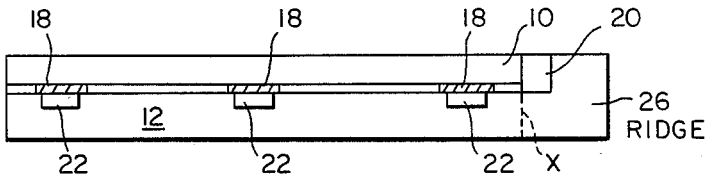

Referring now to FIGS. 5*a*–5*c*, an integrated electro-optic chip capable of performing modulo 3 addition is shown in accordance with the present invention, having an optical substrate and an electrically active substrate 12. Sets of intersecting vertical waveguides 14 and horizontal waveguides 16 are formed on the surface of the optical substrate 10. Either single mode or multimode waveguides are possible. The three vertical waveguides 14 correspond to one set of inputs (labeled 0, 1, 2) and the three horizontal waveguides 16 correspond to a second set of inputs (also labelled 0, 1, 2). In general, the number of vertical and horizontal waveguides will each be N, where N is the modulus of interest for the residue number computation or multi-value logic to be performed.

Scattering patches 18, formed by one of the above described techniques, are located at the intersection of the vertical and horizontal waveguides 14 and 16. The plurality of waveguides 14 and 16 are spaced to correspond with the spacing of light sources 20 provided in the electrically active substrate 12. The light sources 20 provide the input light signals to the vertical and horizontal waveguides 14 and 16 and are selectively energized by drive circuitry 21 based on received data inputs. An array of detectors 22 is also provided in the electrically active substrate 12, and are aligned to correspond to the scattering patches 18. Each detector 22 is connected to an amplifier 28 (See also FIG. 6) and a threshold circuit 24 that triggers only when light from both a corresponding vertical and horizontal waveguide is scattered into the detector 22. The output signal from each threshold circuit 24 is provided to a corresponding output terminal 25.

The optical substrate 10 is attached to the top of the electrically active substrate 12, for example by UV curing epoxy, so that the scattering patches 18 are aligned with and proximate to the detectors 22. Thus, the optical substrate 10 of FIG. 5*a* is flipped over and placed down on the electrically active substrate 12 shown in FIG. 5*b*.

Although the use of scattering patches is preferred, the invention may also be practical with evanescent coupling wherein the detectors are positioned proximate the intersection regions of the waveguides 14 and 16.

A more detailed view of the coupling into and out of the optical substrate is shown in FIG. 6. The sources 20 are edge emitting sources that are set on a ridge 26 of the electrically active substrate 12, so that the sources 20 are at the correct height to efficiently couple into the waveguides. It will be readily understood that the ridge 26 may be formed by building up the ridge from a base substrate or etching a base substrate to form the ridge. Light scattering from the scattering patch 18 is detected by a PIN type detector 22 which is directly connected to an FET amplifier 28. The threshold circuit 24 (not shown in FIG. 6) in the modulo 3 adder of FIG. 5*b* serves to discriminate between a first level of light intensity received by detector 22 corresponding to one or none of the light sources 20 being energized, and a second level of light intensity corresponding to two energized light sources 20.

Other structural configurations other than those specifically illustrated in the drawings can be provided in accordance with the present invention. For example, other means may be provided for coupling light from the sources 20 into the vertical and horizontal waveguides such as by providing a separate remote source (not part of the substrate 12) and coupling the remote source to the waveguides by means of a fiber optic waveguide. The threshold circuits 24 and the drive circuit 21 may also be integrated in the electrically active substrate 12 or provided as remote devices. In addition, the connection pattern illustrated in FIG. 5*b* is for a modulo 3 adder, but it will be readily apparent from the above that other arithmetic and logic units other than the modulo 3 adder set forth above may be readily formed as an integrated electro-optic chip. Also, multiple electrically active substrates may be employed instead of the single electrically active substrate 12 For example, two linear source arrays and a separate detector array may be formed in separate substrates and bonded together with the optical substrate 10 to form an integrated device. The dashed lines x in FIGS. 5*b* and 5*c* illustrate these separate substrates and their bonding points.

A second embodiment of an arithmetic/logic unit (also a modulo 3 adder) according to the present invention is shown in FIG. 7. In this embodiment, two sets of optical waveguides 30 and 32 are provided on the surface of an optical substrate 34. Light may be coupled into waveguides 30 and 32 in the same manner described above in reference to FIGS. 5*b* and 6. The waveguides 30 are positioned at an angle $\theta$ from an edge normal (N) and the waveguides 32 are positioned at an angle $-\theta$ from the edge normal (N). Sets of electrical coplanar conductors 36 are laid out on the electrically active substrate (not shown) parallel to the normal (N) so that the intersections of the optical waveguides 30 and 32 lie between the electrical conductors. A voltage (V) is applied across one end of each pair of electrical conductors 36.

A more detailed illustration of the intersection regions is shown in FIG. 8. A scattering patch 36 is formed on each optical waveguide just downstream of the intersection point. Two detectors 38 are arranged on the active substrate to be directly adjacent the scattering patches 36 provided on the waveguides 30 and 32. InP photoconductive switches as described by Leonberger in a paper entitled, *Applications of InP Photoconductive Switches,* SPIE Vol. 272 High Speed Photodetectors (1981) , incorporated herein by reference, may be employed for the detectors 38. The detectors 38 are connected in series so that the series resistance only goes low when light is present on both detectors simultaneously. When low resistance occurs, the electrical conductors are shorted which propagates a pulse along the electrical conductors in both directions. The downward propagating pulse constitutes the desired output signal. The upward propagating pulse must reach the end of the substrate before the next operation of the device can be performed. For a typical device with a modulus of 31 and a 50 micron spacing between the intersection points, a waiting period of about 5 psec would result.

The advantage of the embodiment of FIG. 6 over the embodiment shown in FIG. 5 is that throughput delays can be equalized. If COS $\theta$ is equal to the ratio of the electronic to optic propagation velocities, the output will arrive at the same time, independent of which sources are turned on.

Although the invention has been described relative to specific embodiments thereof, it is not so limited, and numerous variations and modifications thereof will be readily apparent to those skilled in the art in light of the above teaching. It is therefore to be understood that within the scope of the appended claims the invention may be practiced otherwise than as specifically described.

What is claimed is:

1. An integrated electro-optic arithmetic/logic device comprising:
   (a) an optical substrate having a plurality of optical waveguides formed in a desired pattern thereon, said optical waveguides intersecting one another to form a plurality of intersection regions;
   (b) a plurality of separately energized light sources corresponding in number to the number of said waveguides, wherein energized light sources correspond to inputs of a desired arithmetic or logic operation to be performed;
   (c) means for coupling light from said plurality of light sources to said corresponding waveguides; and
   (d) an electrically active substrate having a plurality of electro-optic detectors corresponding to said plurality of intersecting regions, and a plurality of output terminals, each detector positioned proximate said corresponding intersecting region for receiving light therefrom, said detectors connected in circuit to said output terminals of said electrically active substrate to provide an arithmetic or logical output of said desired arithmetic or logic operation respectively, and wherein said electrically active substrate has a ridge wherein said plurality of light sources are located.

2. An integrated electro-optic device as claimed in claim 1, wherein said plurality of waveguides are arranged vertically and horizontally to form an array of intersection regions.

3. An integrated electro-optic device as claimed in claim 1, wherein said light sources are edge emitting devices.

4. An integrated electro-optic device as claimed in claim 1, wherein said plurality of detectors each comprise a PIN diode coupled to an FET amplifier.

5. An integrated electro-optic arithmetic/logic device comprising:
   (a) an optical substrate having a plurality of optical waveguides formed in a desired pattern thereon, said optical waveguides intersecting one another to form a plurality of intersection regions, wherein said plurality of waveguides are arranged in first and second groups, said first group being arranged at an angle theta from a normal axis of said electro-optic device and said second group being arranged at an angle -theta from said normal axis, wherein the cosine of theta is equal to the ratio of the electronic propagation velocity in said conductor pairs to the optic propagation velocity in said plurality of waveguides;
   (b) a plurality of separately energized light sources corresponding in number to the number of said waveguides, wherein energized light sources correspond to inputs of a desired arithmetic or logic operation to be performed;
   (c) means for coupling light from said plurality of light sources to said corresponding waveguides; and
   (d) an electrically active substrate having a plurality of electro-optic detectors corresponding to said plurality of intersecting regions, and a plurality of output terminals, each detector positioned proximate said corresponding intersecting region for receiving light therefrom, said detectors connected in circuit to said output terminals of said electrically active substrate to provide an arithmetic or logical output of said desired arithmetic or logic operation respectively.

6. An integrated electro-optic device as claimed in claim 5, further comprising conductor pairs of first and second electrical conductors formed on said electrically active substrate such that said plurality of intersecting regions are located between said first and second electrical conductors of said conductor pairs and wherein said plurality of detectors each comprise a pair of photodetectors electrically connected in series between said first and second electrical conductors of said conductor pairs.

7. An integrated electro-optic device as claimed in claim 6, further comprising scattering patches positioned at said intersecting regions on the surface of said optical substrate.

8. An integrated electro-optic device as claimed in claim 5, further comprising scattering patches positioned at said intersecting regions on the surface of said optical substrate.

9. Apparatus for performing arithmetic operations in residue arithmetic comprising:

(a) a first and a second plurality of light sources each corresponding in number to N wherein N is a given modulus;

(b) means for energizing a first one of said first plurality of light sources corresponding to the residue of a first number modulo said given modulus;

(c) means for energizing a second one of said second plurality of light sources corresponding to the residue of a second number modulo said given modulus;

(e) an optical substrate coupled to said electrically active substrate, said optical substrate including means for directing light from said first and second energized ones of said light sources to intersect each other in an intersecting region;

(f) an electrically active substrate having detection means for detecting light intensity at said intersecting region, said detection means including photodetectors formed in said electrically active substrate; and (g) discrimination means formed in said electrically active substrate for discriminating at said intersecting region between:

(1) a first state, wherein a first level of light intensity is detected resulting from light transmitted to the detecting means from only one or none of said first and second energized ones of said light sources, and (2) a second state, wherein a second level of light intensity is detected resulting from light transmitted to the detecting means from both of said first and second energized ones of said light sources, wherein said first and second states indicate an output state of the arithmetic operation, wherein said electrically active substrate includes a ridge in which said light sources are located and said light sources comprise edge emitting devices.

10. An apparatus as claimed in claim 9, wherein said means for directing comprises optical waveguides formed on said optical substrate.

11. An apparatus as claimed in claim 10, wherein said detecting means includes scattering patches formed in said waveguides which correspond to the intersection points of said waveguides.

12. Apparatus for performing arithmetic operations in residue arithmetic comprising:

(a) a first and a second plurality of light sources each corresponding in number to N wherein N is a given modulus;

(b) means for energizing a first one of said first plurality of light sources corresponding to the residue of a first number modulo said given modulus;

(c) means for energizing a second one of said second plurality of light sources corresponding to the residue of a second number modulo said given modulus;

(e) an optical substrate coupled to said electrically active substrate, said optical substrate including means for directing light from said first and second energized ones of said light sources to intersect each other in an intersecting region;

(f) an electrically active substrate having detection means for detecting light intensity at said intersecting region, said detection means including photodetectors formed in said electrically active substrate; and (g) discrimination means formed in said electrically active substrate for discriminating at said intersecting region between:

(1) a first state, wherein a first level of light intensity is detected resulting from light transmitted to the detecting means from only one or none of said first and second energized ones of said light sources, and (2) a second state, wherein a second level of light intensity is detected resulting from light transmitted to the detecting means from both of said first and second energized ones of said light sources, wherein said first and second states indicate an output state of the arithmetic operation, wherein said discriminating means comprises an electronic thresholding circuit.

13. Apparatus for performing arithmetic operations in residue arithmetic comprising:

(a) a first and a second plurality of light sources each corresponding in number to N wherein N is a given modulus;

(b) means for energizing a first one of said first plurality of light sources corresponding to the residue of a first number modulo said given modulus;

(c) means for energizing a second one of said second plurality of light sources corresponding to the residue of a second number modulo said given modulus;

(e) an optical substrate coupled to said electrically active substrate, said optical substrate including means for directing light, including optical waveguides formed on said optical substrate, from said first and second energized ones of said light sources to intersect each other in an intersecting region;

(f) an electrically active substrate having detection means for detecting light intensity at said intersecting region, said detection means including photodetectors formed in said electrically active substrate;

(g) conductor pairs of first and second electrical conductors formed on said electrically active substrate such that said intersecting regions are located between said first and second electrical conductors of said conductor pairs and wherein said photodetectors comprise a pair of detection elements electrically connected in series between said first and second electrical conductors of said conductor pairs; and (h) discrimination means formed in said electrically active substrate for discriminating at said intersecting region between:

(1) a first state, wherein a first level of light intensity is detected resulting from light transmitted to the detecting means from only one or none of said first and second energized ones of said light sources, and (2) a second state, wherein a second level of light intensity is detected resulting from light transmitted to the detecting means from both of said first and second energized ones of said light sources, wherein said first and second states indicate an output state of the arithmetic operation.

14. An apparatus as claimed in claim 13, wherein said waveguides are arranged in first and second groups, said first group being arranged at an angle theta from a normal axis of said apparatus and said second group being arranged at an angle -theta from said normal axis, wherein the cosine of theta is equal to the ratio of the electronic propagation velocity in said conductor pairs to the optic propagation velocity in said waveguides.

15. An apparatus as claimed in claim 13, further including scattering patches positioned at said intersecting regions on the surface of said optical substrate.

16. A method of manufacturing an integrated electro-optic arithmetic/logic device comprising the steps of:

(a) forming a plurality of optical waveguides in a desired pattern on an optical substrate, said optical waveguides intersecting one another to form a plurality of intersection regions;

(b) forming a ridge in an electrically active substrate;

(c) forming (1) a plurality of separately energized light sources corresponding in number to the number of said waveguides in said ridge, wherein energized light sources correspond to inputs of a desired arithmetic or logic operation to be performed, (2) a plurality of electro-optic detectors corresponding to said plurality of intersecting regions, and (3) a plurality of output terminals, said detectors being connected to said output terminals of said electrically active substrate to provide an arithmetic or logical output of said desired arithmetic or logic operation respectively; and (c) bonding said optical substrate to said electrically active substrate such that said detectors are positioned proximate said corresponding intersection regions for receiving light therefrom.

17. A method as claimed in claim 16, wherein said optical substrate is bonded to said electrically active substrate with a UV curing epoxy.

18. A method of manufacturing an integrated electro-optic arithmetic/logic device comprising the steps of:

(a) forming a plurality of optical waveguides in a desired pattern on an optical substrate, said optical waveguides intersecting one another to form a plurality of intersection regions, wherein said plurality of waveguides are arranged in first and second groups, said first group being arranged at an angle theta from a normal axis of said electro-optic device and said second group being arranged at an angle -theta from said normal axis, wherein the cosine of theta is equal to the ratio of the electronic propagation velocity in said conductor pairs to the optic propagation velocity in said plurality of waveguides;

(b) forming (1) a plurality of separately energized light sources corresponding in number to the number of said waveguides on an electrical substrate, wherein energized light sources correspond to inputs of a desired arithmetic or logic operation to be performed, (2) a plurality of electro-optic detectors corresponding to said plurality of intersecting regions, and (3) a plurality of output terminals, said detectors being connected to said output terminals of said electrically active substrate to provide an arithmetic or logical output of said desired arithmetic or logic operation respectively; and (c) bonding said optical substrate to said electrically active substrate such that said detectors are positioned proximate said corresponding intersection regions for receiving light therefrom.

* * * * *